United States Patent [19]

Beevers et al.

[11] 4,352,668

[45] Oct. 5, 1982

[54] DETACHABLE TOW BAR ASSEMBLY

[75] Inventors: Shannon D. Beevers, Napa, Calif.; Robert E. Croxen, 40 Iry Ct., Yountville, Calif. 94599

[73] Assignee: Robert E. Croxen, Yountville, Calif.

[21] Appl. No.: 165,222

[22] Filed: Jul. 1, 1980

[51] Int. Cl.[3] ..... B60P 3/10; B63B 21/64; B63C 13/001

[52] U.S. Cl. ..... 114/344; 114/364; 114/343

[58] Field of Search ..... 9/1.2, 1.7; 180/74; 114/270, 221 R; 280/414 A; 248/354 S; 403/43, 44; 441/343, 344, 363

[56] References Cited

U.S. PATENT DOCUMENTS

| | | | |
|---|---|---|---|
| 1,472,992 | 11/1923 | Roeglin | 248/354 S |
| 2,909,378 | 10/1959 | Borchers | 280/414 A |
| 3,283,347 | 11/1966 | Martin | 9/1.2 |
| 3,295,864 | 1/1967 | Norrby | 9/1.2 |
| 3,755,835 | 9/1973 | Boersig | 9/1.2 |
| 3,841,662 | 10/1974 | Howell | 280/414 A |
| 4,157,200 | 6/1979 | Johnson | 9/1.2 |

*Primary Examiner*—Trygve M. Blix

*Assistant Examiner*—D. W. Keen

*Attorney, Agent, or Firm*—Manfred M. Warren; Robert B. Chickering; Glen R. Grunewald

[57] ABSTRACT

The invention relates to a detachable tow bar assembly for use in towing a small boat from campsite to water and return, and involves a pair of bow engageable elements, each adapted to straddle the foremost edge of the bow of such boat, such bow engageable elements being supported in spaced relationship to engage such bow at spaced locations thereon. The supporting apparatus involves a pair of angularly related solid bars, rigidly connected at one end, with each bar hingedly supporting one of the bow engageable elements. The bow engageable elements may be held in pressure engagement against the bow by a turnbuckle anchored at end to one of the rigid bars in proximity to the apex of the angle form between them, while at its other end, the turnbuckle is provided with a hook or similar devices to engage an eye or clevis affixed to the bow of the boat at a location intermediate the position of engagement of the bow by the bow engageable elements. A short draw bar for attachment to the hitch of a camper or the like, is adjustably mounted on one of the rigid bars.

3 Claims, 3 Drawing Figures

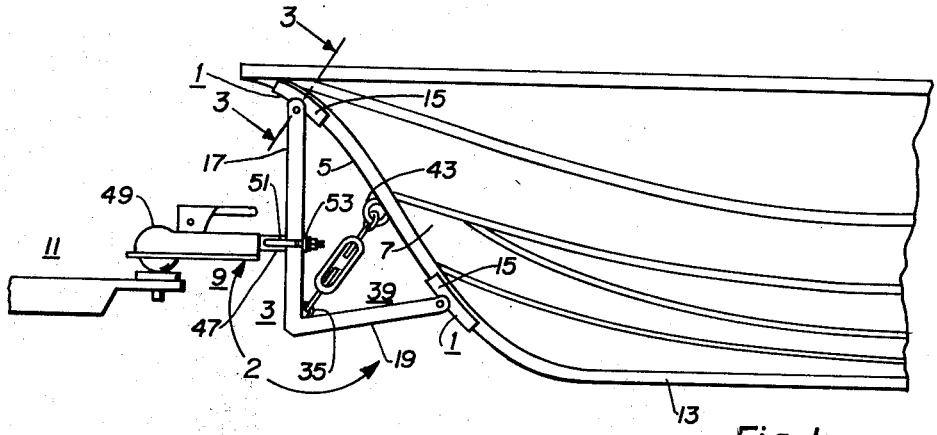
Fig. 1
Fig. 3
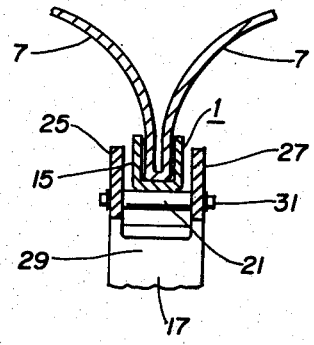
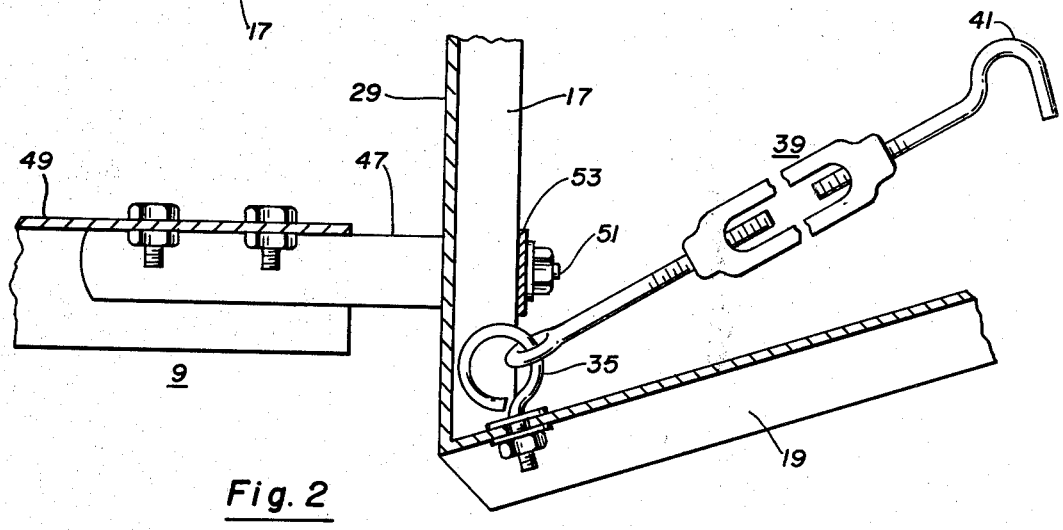
Fig. 2

DETACHABLE TOW BAR ASSEMBLY

THE INVENTION

The invention relates to draw bars and more particularly to a detachable draw bar assembly adapted primarily for use with small boats, to facilitate handling of such boats in the process of launching and retrieving the same.

Small boats, currently for the most part of aluminum and powered by a removable outboard motor, are employed, in large measure, for fishing and other recreational activities, and are small enough to be carried on campers for hauling to campsites usually located within range of water.

Such boats when unloaded from the camper, are usually then dragged from the campsite to a dock with a ramp for launching and then dragged back to the campsite when no longer being used. To facilitate such operation, retractable wheels at the rear may be utilized, but in any event, the dragging of such boat from the campsite to the ramp and back, is a chore, particularly if the campsite is some distance from the dock, and more so, if the boat be loaded with an outboard motor, fishing gear and supplies.

Frequently, to reduce such chore, the load is carried separately to and from the dock and this necessitates time in loading and unloading of the boat at the ramp, much to the discomfort and inconvenience, not only the users, but others who might be waiting to launch or retrieve their boats.

Among the objects of our invention are:

1. To provide a novel and improved means to facilitate hauling a boat a short distance as from a campsite to a launching ramp and return;

2. To provide a novel and improved detachable tow bar assembly adaptable for use in hauling a boat short distances;

3. To provide a novel and improved detachable tow bar assembly for use with a boat and which can be attached and removed without necessitating prior changes in the boat structure;

4. To provide a novel and improved detachable tow bar assembly for a boat, which may be quickly attached and just as quickly removed from the boat;

5. To provide a novel and improved detachable tow bar assembly for a boat, which can be manufactured economically.

Additional objects of our invention will be brought out in the following description of a preferred embodiment of the same, taken in conjunction with the accompanying drawings wherein;

FIG. 1 is a view depicting a boat with our novel and improved tow bar assembly installed thereon;

FIG. 2 is a view in section taken in the plane 2—2 of FIG. 1;

FIG. 3 is a view in section taken in the plane 3—3 of FIG. 1.

Referring to the drawings for details of our invention, the same broadly involves a pair of bow engageable means 1 with means 3 for holding the bow engageable means is spaced relationship and under pressure against the foremost edge 5 of the bow 7 of a boat. A tow bar assembly 9 is mounted on the holding means for connection to the hitch 11 of the vehicle which is to be employed in hauling the boat, and such vehicle will in all likelihood be the camper at the campsite.

Each of the bow engageable means should be capable of straddling the foremost edge of the bow and, preferably, should have a sectional contour substantially conforming to the transverse curvature of the bow. Should the foremost edge of the bow constitute an extension of the rectangular keel 13 of the boat, as depicted in the drawings, then each of the bow engageable means may take the form of the short section of channel 15 adapted to comfortably fit over the edge of the bow.

These bow engageable channel sections are supported by a pair of angularly related rigid bars 17, 19 solidly connected together at one end, and each supporting at its other end, one of the bow engageable means, which is preferably hingedly secured thereto, to enable it to accommodate itself to the vertical contour of the edge of the bow, at the location of engagement.

To facilitate such hinge attachment of the bow engageable means to its associated bar, each channel section 15 is provided at an intermediate point, with a transverse tube 21 while the bar is preferably formed of channel of sufficient width to receive the transverse tube between its side walls 25, 27. A section of the channel floor 29 at its supporting end, is removed as by making a couple of saw cuts adjacent the side walls and then turning the end of the channel floor inwardly into the channel to free the proximate end walls sufficiently to receive the transverse tube between them and permit angular movement of the channel section. A pin 31 through the side walls and the transverse tube will then hold the bow engageable channel section in hinged relationship to its supporting bar..

At the apex of the angle formed by the two supporting bars, an eye bolt 35 is installed, to which may be anchored, one end of a turnbuckle assembly 39, the other end of which terminates preferably in a hook 41 adapted to engage an eye 43 on the foremost edge of the bow, at a location between the bow engageable channel sections. By tightening the turnbuckle, the bow engageable channel sections will be pressure clamped to the bow, whereby the angularly related bars will be rigidly held in position. One of these bars 17 will occupy a substantially vertical position, and to this bar is adjustably mounted a tow bar 47 with a conventional means 49 affixed thereto for coupling to a conventional hitch. The adjustable mounting of the two bar enables the adjustment to match that of the hitch to which the tow bar assembly is to be coupled.

A simple though effective approach toward adjustably mounting the tow bar 47 to the bar 17 involves welding a stud 51 to each side wall of the tow bar, and with the tow bar of similar width as the bar 17, these studs will straddle the bar 17, and the tow bar can then be adjustably mounted to the bar 17 by applying a cross strip 53 to the studs and then bolting same by application of nuts to the studs.

Since most aluminum boats come provided with an eye 43, no alterations of such boats are necessary for installation and removal of the tow bar assembly of the present invention.

The tow bar assembly thus described is not only extremely simple structurally, but may be readily attached to a boat by positioning the bow engageable means and then tightening up on the turnbuckle, and just as simply removed by merely loosening up on the turnbuckle.

Attributable to the hinge connection of the bow engageable channel sections, the tow bar assembly will automatically adapt itself to differences in vertical curvature of the bow of the boat to which it is being attached.

Thus, the use of the tow bar assembly of the present invention is not confined to any particular boat, in that it may be readily removed and installed on other boats and, when installed, the boat may be loaded at the campsite and hauled by the camper to the dock and lowered down the ramp to launch it, and likewise, when the boat returns, it may be similarly hauled up the ramp and towed to the campsite without the necessity and inconvenience of first removing the load therefrom.

While we have illustrated and described our invention in its preferred form and in great detail, it will be appreciated that the same is subject to alteration and modification without departing from the underlying principles involved, and we accordingly do not desire to be limited in out protection to the specific details illustrated and described except as may be necessitated by the appended claims.

We claim:

1. A detachable tow bar assembly, primarily for use in towing a small boat, said tow bar assembly comprising a pair of independent concave bow engageable means, each adapted to straddle the foremost edge of the bow of said boat, means including a pair of angularly disposed, rigid arms solidly connected at one end to each other with one of said bow engageable means carried on the opposite end of each arm, means removeably tensioning said assembly to retain the same against said bow and a detachable tow bar assembly including a tow bar attaching means being adjustably mounted on one of said rigid arms.

2. A detachable tow bar assembly in accordance with claim 1, characterized by said means for removably pressuring said bow engageable means against such bow including a turnbuckle assembly connected at one end in the neighborhood of the apex of the angularly related arms and adapted at its other end for removable connection to such bow at a location thereon intermediate said bow engageable means.

3. A detachable tow bar assembly in accordance with claim 1, characterized by means hingedly securing each of said bow engageable means to its respective supporting bar.

* * * * *